US008216393B2

(12) United States Patent
Brunner et al.

(10) Patent No.: US 8,216,393 B2
(45) Date of Patent: Jul. 10, 2012

(54) METHOD FOR THE PRODUCTION OF POWDER COMPOSITE CORES AND POWDER COMPOSITE CORE

(75) Inventors: Markus Brunner, Bessenbach (DE); Georg Werner Reppel, Hammersbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 580 days.

(21) Appl. No.: 12/308,514

(22) PCT Filed: Jul. 11, 2007

(86) PCT No.: PCT/IB2007/052772

§ 371 (c)(1), (2), (4) Date: Apr. 10, 2009

(87) PCT Pub. No.: WO2008/007346

PCT Pub. Date: Jan. 17, 2008

(65) Prior Publication Data

US 2010/0237978 A1 Sep. 23, 2010

Related U.S. Application Data

(60) Provisional application No. 60/820,225, filed on Jul. 24, 2006.

(30) Foreign Application Priority Data

Jul. 12, 2006 (DE) ..... 10 2006 032 517

(51) Int. Cl.
*H01F 1/147* (2006.01)
*H01F 1/24* (2006.01)
*H01F 1/26* (2006.01)

(52) U.S. Cl. ..... 148/104; 148/306; 148/307; 148/310; 148/311; 148/312; 148/313; 148/315

(58) Field of Classification Search ..... None
See application file for complete search history.

(56) References Cited

U.S. PATENT DOCUMENTS

| | | | | |
|---|---|---|---|---|
| 4,808,326 | A | 2/1989 | Tanino et al. | |
| 5,800,636 | A | 9/1998 | Tsukada et al. | |
| 6,312,531 | B1 | 11/2001 | Matsutani et al. | |
| 6,537,389 | B1 * | 3/2003 | Aichele et al. | 148/307 |
| 6,808,807 | B2 | 10/2004 | Anand et al. | |
| 7,033,413 | B2 | 4/2006 | Iyoda et al. | |
| 7,172,660 | B2 | 2/2007 | Song et al. | |
| 7,175,717 | B2 | 2/2007 | Song et al. | |
| 2002/0124914 | A1 | 9/2002 | Kim | |
| 2003/0127157 | A1 | 7/2003 | Iyoda et al. | |
| 2005/0028889 | A1 | 2/2005 | Song et al. | |
| 2005/0034787 | A1 | 2/2005 | Song et al. | |

FOREIGN PATENT DOCUMENTS

| | | | |
|---|---|---|---|
| DE | 42 30 986 | A1 | 3/1993 |
| DE | 698 15 645 | T2 | 12/2003 |
| DE | 103 14 564 | A1 | 12/2004 |
| DE | 103 48 808 | A1 | 3/2005 |
| DE | 103 48 810 | A1 | 3/2005 |
| EP | 0 112 577 | A1 | 7/1984 |
| EP | 0 869 517 | A1 | 10/1998 |
| EP | 0 977 216 | A1 | 2/2000 |
| EP | 0 926 688 | B1 | 6/2003 |
| EP | 1 592 085 | A1 | 11/2005 |
| EP | 1 598 836 | A1 | 11/2005 |
| EP | 0579088 | A1 | 11/2005 |
| JP | 52091196 (A) | | 8/1977 |
| JP | 09-260126 | | 10/1997 |
| JP | 2003-051406 | | 2/2003 |
| JP | 2003-059710 | | 2/2003 |
| JP | 2004-018889 | | 1/2004 |
| JP | 2005-243769 | | 9/2005 |
| WO | WO 2004/112061 | A2 | 12/2004 |

OTHER PUBLICATIONS

Combined Search and Examination Report for counterpart application GB1200817.3, dated Feb. 3, 2012, issued by UK IP Office.

* cited by examiner

*Primary Examiner* — John Sheehan
(74) *Attorney, Agent, or Firm* — Buchanan, Ingersoll & Rooney PC

(57) ABSTRACT

A powder composite core is to be particularly dense and strong while being produced from soft magnetic alloys. In particular, the expansion of the heat-treated core is to be avoided. To produce this core, a strip of a soft magnetic alloy is first comminuted to form particles. The particles are mixed with a first binder having a curing temperature $T_{1,cure}$ and a decomposition temperature $T_{1,decompose}$ and a second binder having a curing temperature $T_{2,cure}$ and a decomposition temperature $T_{2,decompose}$, wherein $T_{1,cure}<T_{2,cure}\leqq T_{1,decompose}<T_{2,decompose}$. The mix is pressed to produce a magnet core while the first binder is cured. The magnet core is then subjected to a heat treatment accompanied by the curing of the second binder at a heat treatment temperature $T_{Anneal}>T_{2,cure}$.

40 Claims, No Drawings

METHOD FOR THE PRODUCTION OF POWDER COMPOSITE CORES AND POWDER COMPOSITE CORE

This application claims benefit of the filing date of DE 10 2006 032 517.6, filed Jul. 12, 2006 and of U.S. Provisional Application Ser. No. 60/820,225, filed Jul. 24, 2006.

BACKGROUND

1. Field

Disclosed herein is a method for the production of magnetic powder composite cores pressed from a mix of alloy powder and binder. Also disclosed herein is a powder composite core.

2. Description of Related Art

In powder composite cores of this type, low hysteresis and eddy-current losses are desired. The powder is typically supplied in the form of flakes provided by comminuting a soft magnetic strip produced using melt spinning technology or by means of water atomisation. These flakes may, for example, have the form of platelets. While flakes of pure iron or iron/nickel alloys are so ductile that they are plastically deformed under the influence of the compacting pressure and result in pressed cores of high density and strength, flakes or powders of relatively hard and rigid materials require binders if cores of adequate strength are to be produced. If the flakes are compacted to form a magnet core using a pressing tool at high pressure, it may be necessary to prevent the expansion of the core due to spring back of the flakes in the subsequent relaxation process by adding a binder. This expansion would result in an undesirable reduction of the density of the core or even in its breaking apart and destruction.

If the magnet cores have a minimal expansion tendency, as in the case of ductile crystalline alloys, mineral binders, for example based on water-soluble silicates, can be used. These binders develop their full effect only after the magnet cores have been dried outside the pressing tool. At this point, the magnet core reaches its final strength.

If, however, the magnet cores tend to expand due to spring back of the flakes, as is typical for cores made of rapidly solidifying, amorphous or nanocrystalline alloys, the binder has to become effective before the pressed core is removed from the tool. For this reason, thermosetting materials which cure within the pressing tool itself are typically used as binders. These, however, have the disadvantage that they are not sufficiently heat-resistant to allow the magnet core to be heat treated in order to adjust its magnetic properties.

SUMMARY

Disclosed herein is a method for the production of a powder composite core, which allows the production of particularly dense and strong magnet cores from alloys produced in a rapid solidification process. Also disclosed herein is a powder composite core with particularly good magnetic properties.

One embodiment of a method described herein for the production of a magnet core comprises the following steps: First, particles of a soft magnetic alloy are made available. The particles may be provided by comminuting strip or strip sections produced in a rapid solidification process or alternatively by means of water atomisation. The particles are mixed with a first binder having a first curing temperature $T_{1,cure}$ and a first decomposition temperature $T_{1,decompose}$ and a second binder having a second curing temperature $T_{2,cure}$ and a second decomposition temperature $T_{2,decompose}$. The binders are selected such that $T_{1,cure}<T_{2,cure}\leqq T_{1,decompose}<T_{2,decompose}$. The mixture is then pressed in a pressing tool to produce a magnet core, the first binder is cured at a temperature $T\leqq T_{1,cure}$ and the magnet core is removed from the tool. Following this, the magnet core is heat treated to adjust its magnetic properties while the second binder is cured at a heat treatment temperature $T_{anneal}>T_{2,cure}$.

According to a basic principle of the method described herein, the heat treatment for adjusting the magnetic properties of the core cannot be omitted. This, however, requires a binder of high thermal stability. This type of binder in turn requires curing conditions which can hardly be implemented within the pressing tool. However, if flakes which have a tendency to spring back are used, a high strength of the magnet core has to be ensured even before the part is removed from the pressing tool. The high thermal stability requirements therefore conflict with the desired simple curing conditions for the binder.

Both these requirements can, however, be met by using not a single binder but at least two binders. The first binder is curable in the pressing tool itself and therefore ensures the stability of the pressed part at its removal from the pressing tool and at the start of the subsequent heat treatment. On the other hand, this first binder does not have to have a high thermal stability. The second binder cannot be cured in the pressing tool. It is only cured in the heat treatment process and only then acts as a binder. The second binder therefore, in a manner of speaking, replaces the first binder at a certain temperature in fulfilling its binding function. In principle, the use of more than two binders is conceivable.

In order to ensure the adequate strength of the core at all times, the second binder has to be cured before the first binder decomposes and loses its binding action, which would result in the expansion of the pressed part.

DETAILED DESCRIPTION OF SPECIFIC EMBODIMENTS

The first binder may, for example, include those selected from the group including epoxy and phenolic resins and epoxydised cyanurates. They are cured in the pressing tool within a very short time at temperatures of 20 to 250° C., preferably of 100 to 220° C. and in particular between 150 and 200° C. When cured, their binder effect is sufficient to prevent the expansion of the pressed part.

Possible second binders include, for example, an oligomer polysiloxane resin, such as methyl polysiloxane, phenyl polysiloxane and methyl phenyl polysiloxane, or a polyimide or polybenzimidazole, preferably not fully imidised. Binders such as oligomer polysiloxane resins are cured at temperatures between approximately 250 and 300° C. by polycondensation and ceramised at temperatures from approximately 400° C. to form a mineral silicate. The binder has to be selected such that its annealing residue amounts to more than 85% of its starting mass at the highest temperature required for heat treatment. This is necessary in order to ensure that the finished magnet core is sufficiently stable after heat treatment.

The mixing ratio of the first and second binders preferably lies within the range between 1:5 and 3:1. The ratio has to be balanced to ensure that the strength of the magnet core is always sufficient even though, apart from a short time, only one binder may display its binding action while the other binder is "inactive".

Before the pressing process, the particles may be coated with at least one of the binders, which may be dissolved in a solvent. As an alternative, both binders may be applied either together or in succession. It is, however, also possible to add at least one of the binders in powder form to the mix prior to pressing.

The second binder is preferably available as a melt at the temperature $T_{1,cure}$. In this case, it can, in addition, serve as a lubricant in the pressing process.

Processing aids, such as lubricants, may be added to the mix. These additives may, for example, include organic or inorganic lubricants, such as waxes, paraffin, metal stearates, boron nitride, graphite or $MoS_2$. In addition, at least one of the binders may contain a fine-particle mineral filler acting as an electrically insulating spacer between individual flakes. In this way, frequency response of the resulting core can be improved while the eddy-current losses of the core in particular are reduced.

In one embodiment disclosed herein, an amorphous iron-based alloy is provided as a soft magnetic alloy. This alloy may have the composition $M_\alpha Y_\beta Z_\beta$, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions: $70 \leqq \alpha \leqq 85$; $5 \leqq \beta \leqq 20$; $0 \leqq \gamma \leqq 20$. Up to 10 atomic percent of the M component may be replaced by at least one element from the group including Ti, V, Cr, Mn, Cu, Zr, Nb, Mo, Ta und W and up to 10 atomic percent of the (Y+Z) component may be replaced by at least one element from the group including In, Sn, Sb und Pb.

A core made of an alloy powder of this type is expediently heat treated at a maximum heat treatment temperature $T_{anneal}$ of 500° C. At these temperatures, there is no crystallisation of the alloy, and the amorphous structure is retained. These temperatures are, however, high enough to relieve the core of pressing stresses.

In an alternative embodiment, an alloy capable of nanocrystallisation is provided as a soft magnetic alloy. This alloy may have the composition $(Fe_{1-a-b}Co_aNi_b)_{100-x-y-z}M_xB_yT_z$ is used, wherein M is at least one element from the group including Nb, Ta, Zr, Hf, Ti, V and Mo, wherein T is at least one element from the group including Cr, W, Ru, Rh, Pd, Os, Ir, Pt, Al, Si, Ge, C and P, and wherein a, b, x, y and z are specified in atomic percent and meet the following conditions: $0 \leqq a \leqq 0.29$; $0 \leqq b \leqq 0.43$; $5 \leqq x \leqq 20$; $10 \leqq y \leqq 22$; $0 \leqq z \leqq 5$.

In an alternative embodiment, the alloy capable of nanocrystallisation has the composition $(Fe_{1-a}M_a)_{100-x-y-z-\alpha-\beta-\gamma}Cu_xSi_yB_zM'_\alpha M''_\beta X_\gamma$, wherein M is Co and/or Ni, wherein M' is at least one element from the group including Nb, W, Ta, Zr, Hf, Ti and Mo, wherein M" is at least one element from the group including V, Cr, Mn, Al, elements of the platinum group, Sc, Y, rare earths, Au, Zn, Sn and Re, wherein X is at least one element from the group including C, Ge, P, Ga, Sb, In, Be und As, and wherein a, x, y, z, α, β and γ are specified in atomic percent and meet the following conditions: $0 \leqq a \leqq 0.5$; $0.1 \leqq x \leqq 3$; $0 \leqq y \leqq 30$; $0 \leqq z \leqq 25$; $0 \leqq y+z \leqq 35$; $0.1 \leqq \alpha \leqq 30$; $0 \leqq \beta \leqq 10$; $0 \leqq \gamma \leqq 10$.

To obtain a nanocrystalline structure, the heat treatment is performed at a temperature $T_{anneal}$ of 480 to 600° C. To protect the magnet core against corrosion, the heat treatment may be performed an inert gas atmosphere.

The magnet core is expediently hot pressed at 150 to 200° C. while the first binder is cured, the pressures being applied lying in the range of 5 to 25 t/cm$^2$.

Relative to the mass of the metallic particles, the joint mass of the binders expediently amounts to 2-8 percent by weight. This ensures an adequate binding action combined with a high density of the core owing to a high flake content.

The method is particularly useful for particles in the form of flakes, in particular flakes with an aspect ratio of at least 2, which have a particularly strong spring back tendency.

The flakes expediently have a maximum diameter d of 500 μm, preferably of 300 μm. A preferred size range for the flakes is $50\ \mu m \leqq d \leqq 200\ \mu m$.

Prior to pressing, the particles are expediently pickled in an aqueous or alcohol solution to reduce eddy-current losses by the application of an electrically insulating coating and then dried.

The particles are typically produced from rapid-solidified strip, a term which covers foil or similar products. Before the strip is processed to produce particles, it is expediently made brittle by heat treatment, and is then comminuted in a cutting mill.

The method disclosed herein offers the advantage that composite cores can be produced even from rigid flakes while their magnetic properties can be adjusted by means of heat treatment. Owing to the use of two binders which so complement each other in their properties, in particular in their reactivity and thermal stability, that the magnet core is sufficiently stable at any point of time in its production and is protected against destruction by the spring back of the flakes, complex process steps and the use of expensive materials become unnecessary. On the contrary, it is possible to use proven binders which are cured in the hot pressing or heat treatment process, making additional process steps unnecessary.

The powder composite core disclosed herein is made of one of the soft magnetic alloys listed above and is thermostable up to temperatures above 600° C. Thermostability denotes the ability of the magnet core to maintain its geometry and not to lose its pressed density as a result of expansion due to spring back even at the high temperatures listed above.

The magnet core described herein comprises decomposition products of an epoxy or phenolic resin-based polymer and, relative to its total mass, 1-5 percent by weight of the annealing residue of a polysiloxane polymer in a ceramised form as a binder.

In an alternative embodiment, the magnet core comprises, relative to its total mass, 1-percent by weight of the annealing residue of a polyimide polymer in a ceramised form.

In a further embodiment, the magnet core comprises, relative to its total mass, 1-5 percent by weight of the annealing residue of a polyimide polymer in a fully imidised form.

The magnet core according to the invention can expediently be used in inductive components such as chokes for correcting the power factor (PFC chokes), in storage chokes, filter chokes or smoothing chokes.

Specific embodiments are described in greater detail below in order to further illustrate and exemplify the method and magnet core disclosed herein, without limiting the scope of the appended claims.

Example 1

Flakes of an alloy with the composition $Fe_{bal}Cu_1Nb_3Si_{15.5}B_7C_{0.12}$ and a diameter d of 0.04 to 0.08 mm, which had been coated with a phosphate layer, were mixed in an amount of 95.9 percent by weight with 2 percent by weight each of a phenolic resin (Bakelite SP 309) as a first binder and a siloxane resin (Silres MK) as a second binder and with 0.1 percent by weight of isostearic acid as a lubricant. The mix was pressed at pressures of 8 t/cm$^2$ and temperatures of 180° C. to produce ring cores. This was followed by heat treatment at temperatures of 560° C. for 1 to 4 hours in an inert gas atmosphere to obtain a nanocrystalline structure.

At 100 Hz and a modulation of 0.1 T, the finished magnet core had a permeability of 62 and hysteresis losses of 754 mW/cm$^3$.

Example 2

Flakes of an alloy with the composition $Fe_{bal}Cu_1Nb_3Si_{15.5}B_7$ and a diameter d of less than 0.04 mm, which had been coated with a phosphate layer, were mixed in an amount of 95.9 percent by weight with 2 percent by weight each of a phenolic resin (Bakelite SP 309) as a first binder and a siloxane resin (Silres MK) as a second binder and with 0.1 percent by weight of zinc stearate as a lubricant. The mix was pressed at pressures of 8 t/cm$^2$ and temperatures of 180° C. to produce ring cores. This was followed by heat treatment at temperatures of 560° C. for 1 to 4 hours in an inert gas atmosphere to obtain a nanocrystalline structure.

At 100 Hz and a modulation of 0.1 T, the finished magnet core had a permeability of 55 and hysteresis losses of 1230 mW/cm$^3$.

Example 3

Flakes of an alloy with the composition $Fe_{bal}Cu_1Nb_3Si_{15.5}B_7$ and a diameter d of 0.08 to 0.12 mm, which had been coated with a phosphate layer, were mixed in an amount of 96.4 percent by weight with 1.5 percent by weight of a phenolic resin (Bakelite SP 309) as a first binder and 2 percent by weight of a siloxane resin (Silres MK) as a second binder and with 0.1 percent by weight of paraffin as a lubricant. The mix was pressed at pressures of 8 t/cm$^2$ and temperatures of 180° C. to produce ring cores. This was followed by heat treatment at temperatures of 560° C. for 1 to 4 hours in an inert gas atmosphere to obtain a nanocrystalline structure.

At 100 Hz and a modulation of 0.1 T, the finished magnet core had a permeability of 71 and hysteresis losses of 590 mW/cm$^3$.

Example 4

Flakes of an alloy with the composition $Fe_{bal}Cu_1Nb_3Si_{15.5}B_7$ and a diameter d of 0.106 to 0.160 mm, which had been coated with a phosphate layer, were mixed in an amount of 96.9 percent by weight with 1 percent by weight of an epoxy resin (Epicotel1055 and hardener) as a first binder and 2 percent by weight of a siloxane resin (Silres 604) as a second binder and with 0.1 percent by weight of boron nitride as a lubricant. The mix was pressed at pressures of 8 t/cm$^2$ and temperatures of 180° C. to produce ring cores. This was followed by heat treatment at temperatures of 560° C. for 1 to 4 hours in an inert gas atmosphere to obtain a nanocrystalline structure.

At 100 Hz and a modulation of 0.1 T, the finished magnet core had a permeability of 110 and hysteresis losses of 480 mW/cm$^3$.

Example 5

Flakes of an alloy with the composition $Fe_{bal}Cu_1Nb_3Si_{15.5}B_7$ and a diameter d of 0.04 to 0.16 mm, which had been coated with a phosphate layer, were mixed in an amount of 95.9 percent by weight with 1.5 percent by weight of a phenolic resin (Bakelite SP 309) as a first binder and 2.5 percent by weight of polybenzimidazole oligomer as a second binder and with 0.1 percent by weight of $MoS_2$ as a lubricant. The mix was pressed at pressures of 8 t/cm$^2$ and temperatures of 180° C. to produce ring cores. This was followed by heat treatment at temperatures of 560° C. for 1 to 4 hours in an inert gas atmosphere to obtain a nanocrystalline structure.

At 100 Hz and a modulation of 0.1 T, the finished magnet core had a permeability of 120 and hysteresis losses of 752 mW/cm$^3$.

Example 6

Flakes of an alloy with the composition $Fe_{bal}Si_{12}B_{12}$ and a diameter d of 0.06 to 0.2 mm, which had been coated with a phosphate layer, were mixed in an amount of 96.3 percent by weight with 1.5 percent by weight of a phenolic resin (Bakelite SP 309) as a first binder and 2 percent by weight of a siloxane resin (Silres MK) as a second binder and with 0.2 percent by weight of hydroxystearic acid as a lubricant. The mix was pressed at pressures of 9 t/cm$^2$ and temperatures of 190° C. to produce ring cores. This was followed by heat treatment at temperatures of 460° C. for 1 to 4 hours in an inert gas atmosphere to relieve mechanical stresses.

At 100 Hz and a modulation of 0.1 T, the finished magnet core had a permeability of 142 and hysteresis losses of 1130 mW/cm$^3$.

Example 7

Flakes of an alloy with the composition $Fe_{bal}Co_{18.1}Si_1B_{14}C_{0.06}$ and a diameter d of 0.06 to 0.125 mm, which had been coated with a phosphate layer, were mixed in an amount of 95.9 percent by weight with 1.5 percent by weight of a phenolic resin (Bakelite SP 309) as a first binder and 2.5 percent by weight of a siloxane resin (Silres 604) as a second binder and with 0.1 percent by weight of zinc stearate as a lubricant. The mix was pressed at pressures of 9 t/cm$^2$ and temperatures of 190° C. to produce ring cores. This was followed by heat treatment at temperatures of 450° C. for 1 to 4 hours in an inert gas atmosphere to relieve mechanical stresses.

At 100 Hz and a modulation of 0.1 T, the finished magnet core had a permeability of 95 and hysteresis losses of 1060 mW/cm$^3$.

Comparative Examples

For comparison, a mix corresponding to example 5 was produced, but instead of 1.5 percent by weight of a phenolic resin (Bakelite SP 309) and 2.5 percent by weight of polybenzimidazole oligomer, 4 percent by weight of polybenzimidazole oligomer were added. The mix therefore did not contain any binder curing at low temperatures. It could not be pressed to produce ring cores at pressures between 6 and 10 t/cm$^2$ and temperatures of 180° C.

In addition, a mix of 95.9 percent by weight of phosphated flakes of the alloy $Fe_{73.5}Nb_3Cu_1Si_{15.5}B_7$ with a diameter of 0.04 to 0.16 mm, 4 percent by weight of a phenolic resin (Bakelite SP 309) and 0.1 percent by weight of $MoS_2$ as a lubricant was prepared. This mix did not contain any binder of particularly high thermal stability. It was pressed at pressures of 8 t/cm$^2$ and temperatures of 180° C. to produce ring cores. After 1-4 hours of hear treatment at 560° C. in an inert gas atmosphere, the cores were expanded due to spring back, and their strength was so low that magnetic measurements were not possible.

These examples indicate that the method described herein is capable of producing highly stable magnet cores with low permeability and hysteresis losses even from rigid flakes. This means that, using the methods described herein, even alloys which form rigid flakes can be pressed to produce composite cores, thus permitting the utilisation of their magnetic properties.

The examples and embodiments described herein are provided to illustrate, rather than limit the scope of, the appended claims.

The invention claimed is:

1. A method for the production of a magnet core, comprising:

providing particles of an amorphous soft magnetic alloy, wherein the soft magnetic alloy has the composition $M_\alpha Y_\beta Z_\gamma$, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions:

$70 \leqq \alpha \leqq 85$;

$5 \leqq \beta \leqq 20$; and $0 \leqq \gamma \leqq 20$;

wherein up to 10 atomic percent of the M component may be replaced by at least one element from the group including Ti, V, Cr, Mn, Cu, Zr, Nb, Mo, Ta and W; and wherein up to 10 atomic percent of the (Y+Z) component may be replaced by at least one element from the group including In, Sn, Sb and Pb;

mixing the particles with a first binder having a curing temperature $T_{1,cure}$ and a decomposition temperature $T_{1,decompose}$ and a second binder having a curing temperature $T_{2,cure}$ and a decomposition temperature $T_{2,decompose}$, wherein $T_{1,cure} < T_{2,cure} \leqq T_{1,decompose} < T_{2,decompose}$;

pressing the mix of particles and binders to the shape of a magnet core;

curing the first binder;

heat treating of the magnet core and curing of the second binder at a heat treatment temperature $T_{anneal} > T_{2,cure}$.

2. The method according to claim 1, wherein the first binder is selected from the group consisting of epoxy resins, phenolic resins, and epoxydised cyanurates.

3. The method according to claim 1, wherein the second binder comprises an oligomer polysiloxane resin.

4. The method according to claim 3, wherein the oligomer polysiloxane resin is selected from the group consisting of methyl polysiloxane, phenyl polysiloxane and methyl phenyl polysiloxane.

5. The method according to claim 1, wherein the second binder comprises a polyimide.

6. The method according to claim 1, wherein the second binder comprises a polybenzimidazole.

7. The method according to claim 1, wherein the first and second binders are mixed in a mixing ratio of the first to second binders that lies within the range between 1:5 and 3:1.

8. The method according to claim 1, wherein the mixing of the particles with the binders comprises coating the particles with at least one of the binders prior to pressing.

9. The method according to claim 1, wherein the mixing of particles with the binders comprises adding at least one of the binders to the mix in powder form prior to pressing.

10. The method according to claim 1, wherein the second binder is present in a melted state at the temperature $T_{1,cure}$.

11. The method according to claim 1, wherein at least one of the binders contains a fine-particle mineral filler.

12. The method according to claim 1, further comprising adding one or more processing aids to the mix of particles and binders.

13. The method according to claim 1, wherein the heat treating is performed at a heat treatment temperature $T_{anneal}$ that is, at most, 500° C.

14. The method according to claim 1, wherein the heat treating is performed in an inert gas atmosphere.

15. The method according to claim 1, wherein the pressing of the mix of particles and binders occurs at a temperature of 20 to 250° C. and further comprises curing of the first binder.

16. The method according to claim 15, wherein the pressing of the mix of particles and binders occurs at a temperature of 100 to 220° C. and further comprises curing of the first binder.

17. The method according to claim 16, wherein the pressing of the mix of particles and binders occurs at a temperature of 150 to 200° C. and further comprises curing of the first binder.

18. The method according to claim 1, wherein pressing of the mix of particles and binders occurs at pressures of 5 to 25 $t/cm^2$.

19. The method according to claim 1, wherein the mass of the first and second binders relative to the mass of the soft magnetic alloy in the mix is 2-8 percent by weight.

20. The method according to claim 1, wherein the particles have the form of flakes.

21. The method according to claim 20, wherein the flakes have an aspect ratio of at least 2.

22. The method according to claim 20, wherein the flakes have a maximum diameter d of 500 μm.

23. The method according to claim 22, wherein the flakes have a maximum diameter d of 300 μm.

24. The method according to claim 20, wherein the diameter d of the flakes is $50\ \mu m \leqq d \leqq 200\ \mu m$.

25. The method according to claim 1, further comprising pickling the particles in an aqueous or alcohol solution, thereby applying an electrically insulating coating to them, and then drying them prior to pressing.

26. The method according to claim 1, further comprising heat treating a strip or foil of a soft magnetic alloy to embrittle it, and then grinding the strip in a cutting mill to produce the particles.

27. The powder composite magnet core prepared by the process of claim 1.

28. The method according to claim 1, further comprising removing the pressed mix in the shape of a magnet core from a pressing tool after curing the first binder and prior to heat treating.

29. The method according to claim 1, wherein the heat treating produces an annealing residue of the second binder that is more than 85% of the starting mass of the second binder at the highest temperature required for heat treatment.

30. The powder composite magnet core according to claim 27, comprising particles of a soft magnetic alloy and decomposition products of a polymer containing an epoxy resin or phenolic resin and, relative to its total mass, 1 to 5 percent by weight of an annealing residue of a polysiloxane polymer in a ceramised form.

31. The powder composite magnet core according to claim 27, comprising particles of a soft magnetic alloy and decomposition products of a polymer containing an epoxy resin or phenolic resin and, relative to its total mass, 1 to 5 percent by weight of an annealing residue of a polybenzimidazol oligomer.

32. The powder composite magnet core according to claim 27, comprising particles of a soft magnetic alloy and decomposition products of a polymer containing an epoxy resin or phenolic resin and, relative to its total mass, 1 to 5 percent by weight of an annealing residue of a polyimide polymer in a fully imidised form.

33. An inductive component comprising a magnet core according to claim 27.

34. The inductive component according to claim 33, wherein the inductive component is a choke for correcting a power factor.

35. The inductive component according to claim 33, wherein the inductive component is a storage choke.

36. The inductive component according to claim 33, wherein the inductive component is a filter choke.

37. The inductive component according to claim 33, wherein the inductive component is a smoothing choke.

38. A method for the production of a magnet core, comprising:

providing particles of a soft magnetic alloy capable of nanocrystallisation, wherein the soft magnetic alloy has the composition $(Fe_{1-a-b}Co_aNi_b)_{100-x-y-z}M_xB_yT_z$, wherein M is at least one element from the group including Nb, Ta, Zr, Hf, Ti, V and Mo, wherein T is at least one element from the group including Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$5 \leqq x \leqq 20$;

$10 \leqq y \leqq 22$; and $0 \leqq z \leqq 5$;

mixing the particles with a first binder having a curing temperature $T_{1,cure}$ and a decomposition temperature $T_{1,decompose}$ and a second binder having a curing temperature $T_{2,cure}$ and a decomposition temperature $T_{2,decompose}$, wherein $T_{1,cure} < T_{2,cure} \leqq T_{1,decompose} < T_{2,decompose}$;

pressing the mix of particles and binders to the shape of a magnet core;

curing the first binder;

heat treating of the magnet core and curing of the second binder at a heat treatment temperature $T_{anneal} > T_{2,cure}$.

39. A method for the production of a magnet core, comprising:

providing particles of a soft magnetic alloy capable of nanocrystallisation, wherein the soft magnetic alloy has the composition $(Fe_{1-a}M_a)_{100-x-y-z-\alpha-\beta-\gamma}Cu_xSi_yB_zM'_\alpha M''_\beta X_\gamma$, wherein M is Co and/or Ni, wherein M' is at least one element from the group including Nb, W, Ta, Zr, Hf, Ti and Mo, wherein M" is at least one element from the group including V, Cr, Mn, Al, elements of the platinum group, Sc, Y, rare earths, Au, Zn, Sn and Re, wherein X is at least one element from the group including C, Ge, P, Ga, Sb, In, Be and As, and wherein a, x, y, z, α, β and γ are specified in atomic percent and meet the following conditions:

$0 \leqq a \leqq 0.5$;

$0.1 \leqq x \leqq 3$;

$0 \leqq y \leqq 30$;

$0 \leqq z \leqq 25$;

$0 \leqq y+z \leqq 35$;

$0.1 \leqq \alpha \leqq 30$;

$0 \leqq \beta \leqq 10$; and $0 \leqq \gamma \leqq 10$;

mixing the particles with a first binder having a curing temperature $T_{1,cure}$ and a decomposition temperature $T_{1,decompose}$ and a second binder having a curing temperature $T_{2,cure}$ and a decomposition temperature $T_{2,decompose}$, wherein $T_{1,cure} < T_{2,cure} \leqq T_{1,decompose} < T_{2,decompose}$;

pressing the mix of particles and binders to the shape of a magnet core;

curing the first binder;

heat treating of the magnet core and curing of the second binder at a heat treatment temperature $T_{anneal} > T_{2,cure}$.

40. The method according to claim 38, wherein the heat treating is performed at a heat treatment temperature $T_{anneal}$ of 480 to 600° C.

* * * * *